US011448452B2

(12) United States Patent
Pisaturo, III

(10) Patent No.: US 11,448,452 B2
(45) Date of Patent: Sep. 20, 2022

(54) SWIVEL FAN GUARDS

(71) Applicant: Heatcraft Refrigeration Products LLC, Richardson, TX (US)

(72) Inventor: Anthony J. Pisaturo, III, Loganville, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 308 days.

(21) Appl. No.: 16/893,367

(22) Filed: Jun. 4, 2020

(65) Prior Publication Data

US 2021/0381747 A1 Dec. 9, 2021

(51) Int. Cl.

| | |
|---|---|
| ***F25D 17/06*** | (2006.01) |
| ***F04D 29/56*** | (2006.01) |
| ***F04D 29/64*** | (2006.01) |
| ***F04D 29/70*** | (2006.01) |
| ***F24F 13/065*** | (2006.01) |

(52) U.S. Cl.

CPC ..... *F25D 17/062* (2013.01); *F04D 29/563* (2013.01); *F04D 29/646* (2013.01); *F04D 29/703* (2013.01); *F24F 13/065* (2013.01); *F25D 17/067* (2013.01); *F25D 2317/0681* (2013.01); *F25D 2317/0682* (2013.01)

(58) Field of Classification Search

CPC .... F04D 29/563; F04D 29/646; F04D 29/703; F04D 29/4226; F04D 25/08; F24F 13/065; F24F 13/20; F24F 13/32; F24F 13/08

See application file for complete search history.

(56) References Cited

U.S. PATENT DOCUMENTS

| | | | | |
|---|---|---|---|---|
| 7,077,624 | B2 * | 7/2006 | Brown | F04D 29/646 415/214.1 |
| 8,974,273 | B2 * | 3/2015 | Uhlenbusch | B60H 1/3442 454/154 |
| 9,683,580 | B2 * | 6/2017 | Tyler | F04D 19/002 |
| 10,317,107 | B2 * | 6/2019 | Nemoto | B60H 1/3421 |
| 2011/0195650 | A1 * | 8/2011 | Uhlenbusch | B60H 1/3442 454/152 |
| 2016/0282008 | A1 * | 9/2016 | Nemoto | B60H 1/3442 |
| 2016/0327058 | A1 * | 11/2016 | Tyler | F04D 19/002 |

* cited by examiner

*Primary Examiner* — Eldon T Brockman
(74) *Attorney, Agent, or Firm* — Johnston IP Law, PLLC

(57) ABSTRACT

In one instance, a cooling unit for cooling a refrigerated room includes a fan base and a fan guard that both twist and rotate to change pitch thereby allowing the cooling unit air to be directed in many directions as desired. The fan base has a flange portion and a conduit portion. The conduit portion of the fan base mates with an opening in a conduit member of the fan guard. The opening in the fan guard is sized and configured to form an interference fit with at least a portion of a conduit portion of the fan base while allowing rotation of the fan guard relative to the fan base about the longitudinal axis. The second longitudinal end of the fan-guard conduit member is at least partially angled to allow the rotation about a lateral axis in order to pitch the direction of the grill front wall.

21 Claims, 9 Drawing Sheets

SWIVEL FAN GUARDS

TECHNICAL FIELD

This application is directed, in general, to cooling units for refrigerated spaces, and more specifically, to swivel fan guards for cooling units.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Refrigeration systems, e.g., a commercial unit cooler, or other heating ventilating and cooling (HVAC) systems come in many sizes and shapes. One application is a refrigerated storeroom or walk-in unit.

SUMMARY

According to an illustrative embodiment, a cooling unit for cooling a refrigerated room includes a cabinet formed with a plurality of panels including a front panel, a fan aperture formed in the front panel, and a fan base, and a fan guard. The fan base includes a flange portion and a conduit portion. The flange portion forms an angle with the conduit portion of between 70 and 110 degrees. The flange portion is coupled to the front panel in a substantially flush manner and about the fan aperture. The fan aperture and fan base are concentric about a longitudinal axis. The cooling unit further includes a fan guard for moveably coupling to the fan base, with the fan guard over the fan base.

The fan guard of the previous paragraph includes a fan-guard conduit member having a first longitudinal end and a second longitudinal end. The first longitudinal end is further from the front panel than the second longitudinal end when in an assembled position. The fan-guard conduit member extends between the first longitudinal end and the second longitudinal end and is concentric about the first longitudinal axis when in the assembled position. The fan guard further includes a grill front wall coupled to the fan-guard conduit member at the first longitudinal end. The grill front wall includes a plurality of protection bars that cover an opening formed at the first longitudinal end of the fan-guard conduit member to avoid unrestricted access to a fan blade while allowing air flow through the grill front wall.

The fan guard also includes an opening formed on the fan-guard conduit member at the second longitudinal end, wherein the opening is sized and configured to form an interference fit with at least a portion of the conduit portion of the fan base while allowing rotation of the fan guard relative to the fan base about the longitudinal axis. The second longitudinal end of the fan-guard conduit member is at least partially angled to allow rotation about a lateral axis in order to pitch the direction of the grill front wall.

According to an illustrative embodiment, a cooling unit for cooling a refrigerated room includes a cabinet formed with a plurality of panels including a front panel, a fan aperture formed in the front panel, a fan base, and a fan guard. The fan base includes a flange portion and a conduit portion. The flange portion is coupled to the front panel in a substantially flush manner and coupled about the fan aperture. The fan aperture and fan base are concentric about a longitudinal axis. The flange portion and the conduit portion are coupled to form an angle of between 80 and 110 degrees between.

The fan guard is moveably coupled to the fan base. The fan guard includes a fan-guard conduit member having a first longitudinal end and a second longitudinal end with a longitudinal distance of L therebetween. The first longitudinal end is further from the front panel than the second longitudinal end when in an assembled position. The fan-guard conduit member extends between the first longitudinal end and the second longitudinal end and is concentric about the longitudinal axis when in the assembled position in a neutral position. The fan guard further includes a grill front wall coupled to the conduit member at the first longitudinal end. The grill front wall comprising a plurality of protection bars that cover an opening formed at the first longitudinal end of the fan-guard conduit member to avoid unrestricted access to a fan blade while allowing air flow through the grill front wall.

The fan guard also includes an opening formed on the fan-guard conduit member at the second longitudinal end that is sized and configured to form an interference fit with the conduit portion of the fan base while allowing rotation about the longitudinal axis when in the assembled position and the neutral position. The second longitudinal end of the fan-guard conduit member is at least partially angled to allow rotation about a lateral axis in order to pitch the direction of the grill front wall. The neutral position is associated with zero pitch.

The conduit portion of the fan base has a distal end that is outward facing when in the assembled position and a proximal portion that is coupled to the flange portion. The distal end of the fan base is formed with a plurality of slots. The plurality of slots is greater than four and wherein each slot of the plurality of slots has a width of at least 0.1 inches. A reduced-thickness lip is formed on the distal end of the conduit portion of the fan base. A longest portion of the conduit portion of the fan base has a length Y and the plurality of slots has a length less than or equal to ½ Y.

The fan guard further includes a plurality of ribs coupled at least partially to the grill front and having a portion coupled to the conduit member on an exterior side. The interference fit between the fan-guard conduit member at the second longitudinal end and the conduit portion of the fan base is loose enough that the fan-guard conduit member may be rotated relative to the conduit portion of the fan base by hand and yet tight enough to not move from mere vibration during operation. The second longitudinal end of the fan-guard conduit member is at least partially angled to form an angled portion and to allow rotation about the lateral axis in order to pitch the direction of the grill front wall, and wherein the angled portion is between 3 and 8 degrees relative to the flange portion of the fan base when in an assembled position and in the neutral position.

A portion of the second longitudinal end of the fan-guard conduit member forms a non-angled portion that is substantially flush with the flange portion of the fan base when in the assembled position and in the neutral position. A lateral width of the fan-guard conduit member is X and wherein the angled portion has length less than ½ X. The second longitudinal end of the fan-guard conduit member is at least partially angled such that a portion of the conduit member is longer on a first longitudinal side than on an opposing second longitudinal side, which is a shorter side; and wherein the shorter side has a length greater than ½ L. The fan base and the fan guard may be formed from a plastic material.

According to an illustrative embodiment, a fan guard and fan base assembly for use as an aspect of a cooling unit for cooling a refrigerated room is presented. The cooling unit includes a cabinet formed with a plurality of panels with a front panel. A fan aperture is formed in the front panel for allowing cooled air from a fan to be discharged.

The fan guard and fan base assembly includes a fan base and fan guard. The fan base includes a flange portion that mounts substantially flush with the front panel when in an assembled position and having a conduit portion coupled to the flange portion. The conduit portion extends outward from the flange portion when in the assembled position. The conduit portion of the fan base has a first longitudinal end and a second longitudinal end. The second longitudinal end is coupled to the flange portion.

The fan guard and fan base assembly further includes a fan guard having a conduit member that extends longitudinally from a first longitudinal end to a second longitudinal end. The second longitudinal end is closest, as compared to the first longitudinal end, to the front panel when in the assembled position. The first longitudinal end of the conduit member of the fan guard is covered by a grill that allows air to pass therethrough but restricts access by a human hand.

An opening at the second longitudinal end of the conduit member of the fan guard is sized and configured to mate with the first longitudinal end of the conduit portion of the fan base and to form an interference fit therebetween. The second longitudinal end of the fan guard is partially angled in shape to form an angled portion and a non-angled portion that allows for rotation about a lateral axis through the fan guard. Other embodiments and aspects of the disclosure are presented as well.

DESCRIPTION OF THE DRAWINGS

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims.

One example of a system is a walk-in refrigeration system as may be used in a restaurant, convenience store, warehouse, or other situation. An example of such a system is presented in FIG. 1. Unless otherwise indicated, as used throughout this document, "or" does not require mutual exclusivity.

Figure 1:
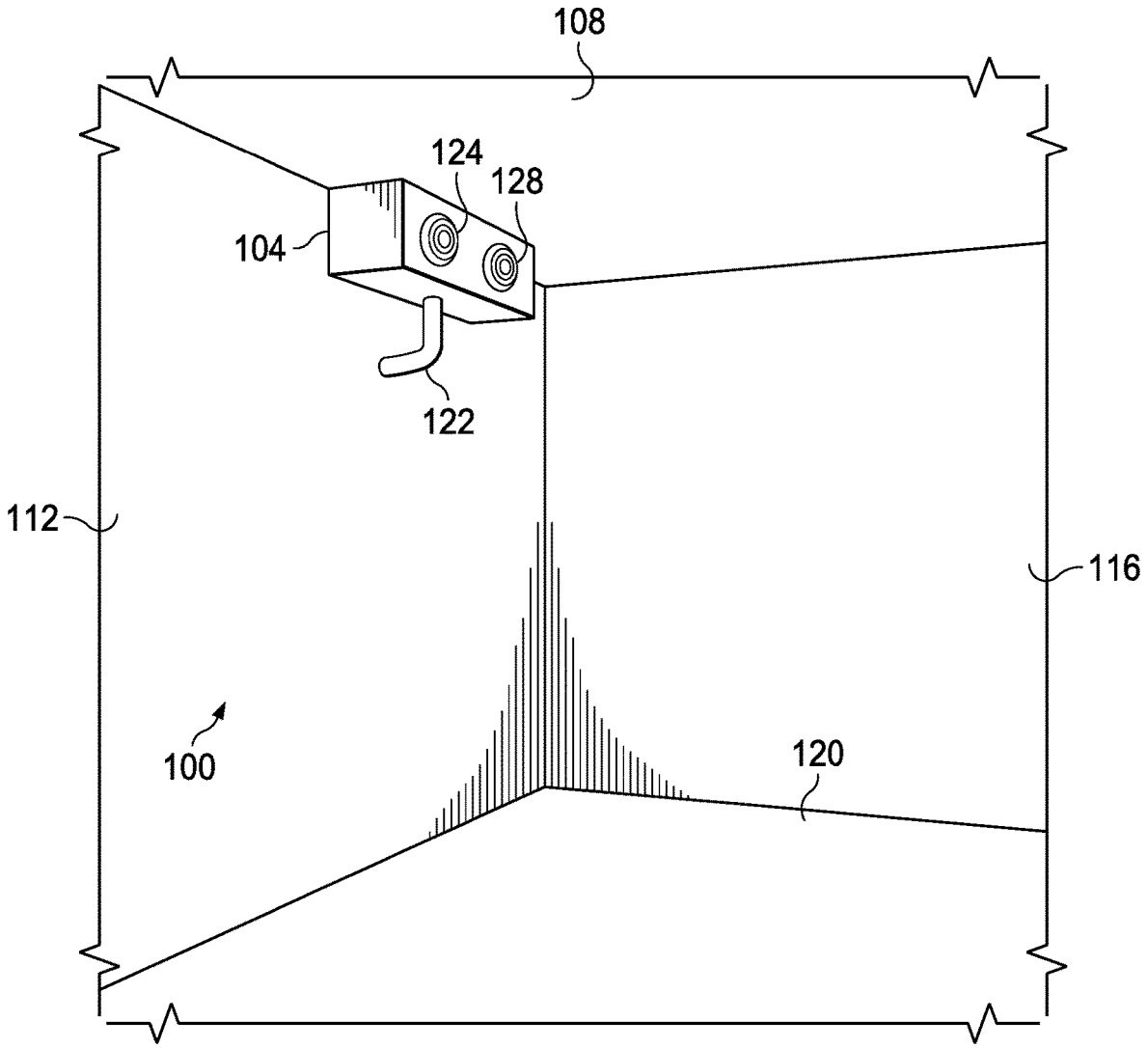
FIG. 1 is a schematic perspective view of a cooling unit in a refrigerated room.

Referring now to the figures and initially to FIG. 1, an illustrative embodiment of a walk-in refrigeration system 100 is presented that includes an illustrative embodiment of a refrigeration unit 104. The refrigeration unit 104 may be a low-profile unit as shown or may take other shapes or be located elsewhere.

The refrigeration unit or cooling unit 104 is shown mounted proximate a ceiling 108 of a walk-in refrigerated room. The room includes a first wall 112, a second wall 116, and a floor 120. Other walls not explicitly shown form a closed spaced that is to be cooled. In other embodiments, the cooling unit 104 may be supported by the floor 120 or mounted elsewhere. A drainage line 122 is shown exiting the refrigeration unit 104. The refrigeration unit 104 includes a first fan 124, or air mover, and a second fan 128, or air mover. It should be understood, however, that the refrigeration unit 104 could include any number of fans, e.g., one, two (as shown), three, four, five, six, or some other number.

Figure 2:
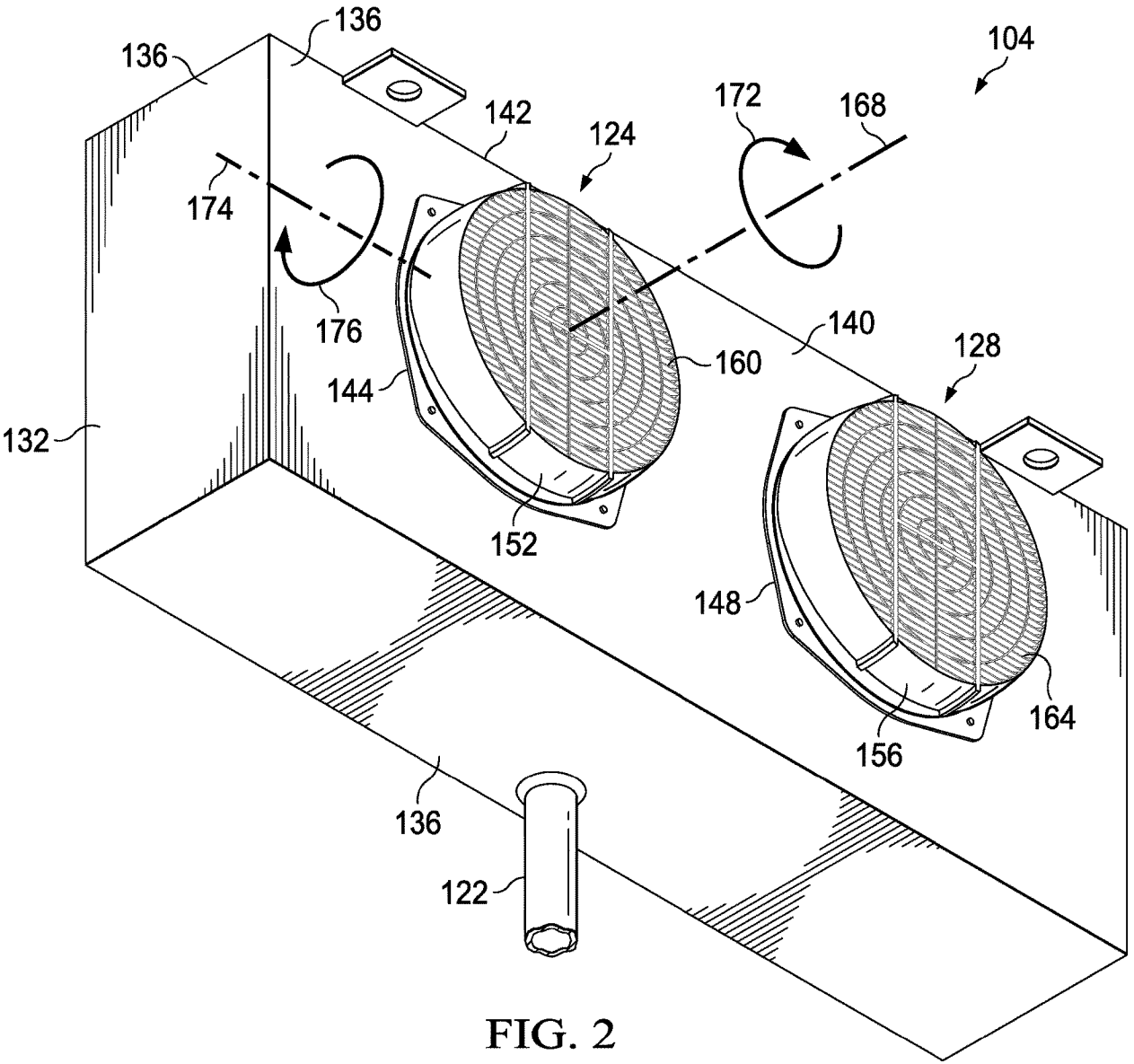
FIG. 2 is a schematic, perspective view of a cooling unit such as the one shown in FIG. 1.

Referring now primarily to FIG. 2, an embodiment of the cooling unit 104 is shown in more detail. The cooling unit 104 includes a cabinet 132 formed with a plurality of panels 136, which may include a front panel 140, a back panel, a top panel 142, a bottom panel, a first side panel, and a second side panel. The panels 136 may be formed from subpanels. The front panel 140, or first panel, is formed with a first fan aperture 144 and a second fan aperture 148. A first fan base 152 may surround the first fan aperture 144, and likewise a second base 156 may surround the second fan aperture 148. The fan apertures 144 and 148 may be covered by a first swivel fan guard 160 and a second swivel fan guard member 164, respectively. The swivel fan guard members 160 and 164 may have any of a plurality of a different grill designs, or patterned designs, and those skilled in the art will appreciate that many designs might be used. As an example, a checkered board, spiral, box, grid, concentric rings, a combination thereof, or other patterns. A plurality of protection bars form the patterned design.

For reference purposes, a longitudinal axis 168 is shown for a first fan guard 160. The longitudinal axis 168 is substantially parallel to the drive shaft of the fan blades.

Rotation 172 about the longitudinal axis 168 may be referred to as "roll" for convenience. Likewise, a lateral axis 174 is shown for the first fan guard 160. The lateral axis 174 is substantially orthogonal to the longitudinal axis 168 and typically goes through a mid-section of the fan base 152. Rotation 178 about the lateral axis 174 may be referred to as "pitch" for convenience.

As those skilled in the art will appreciate, an evaporator coil is located in the interior of the cabinet 132 such that air moved by the fans 124, 128 across the evaporator coils exits through the fan apertures 144, 148 or the evaporator coil as conditioned air. The evaporator coils are part of a closed refrigerant path that also includes a compressor, condenser, and expansion valve. The conditioned air cools the space, e.g., a walk-in room, as desired.

At times, it is desirable to direct the flow of air exiting the fans 124, and 128. According to one embodiment, the swivel fan guards 160, 164 are operable to adjust the direction of the air leaving the fan guards 160, 164 in two ways: by rotating about a center axis of the fan and by rotating (changing pitch) in a direction making an angle with the centerline.

Figure 3:
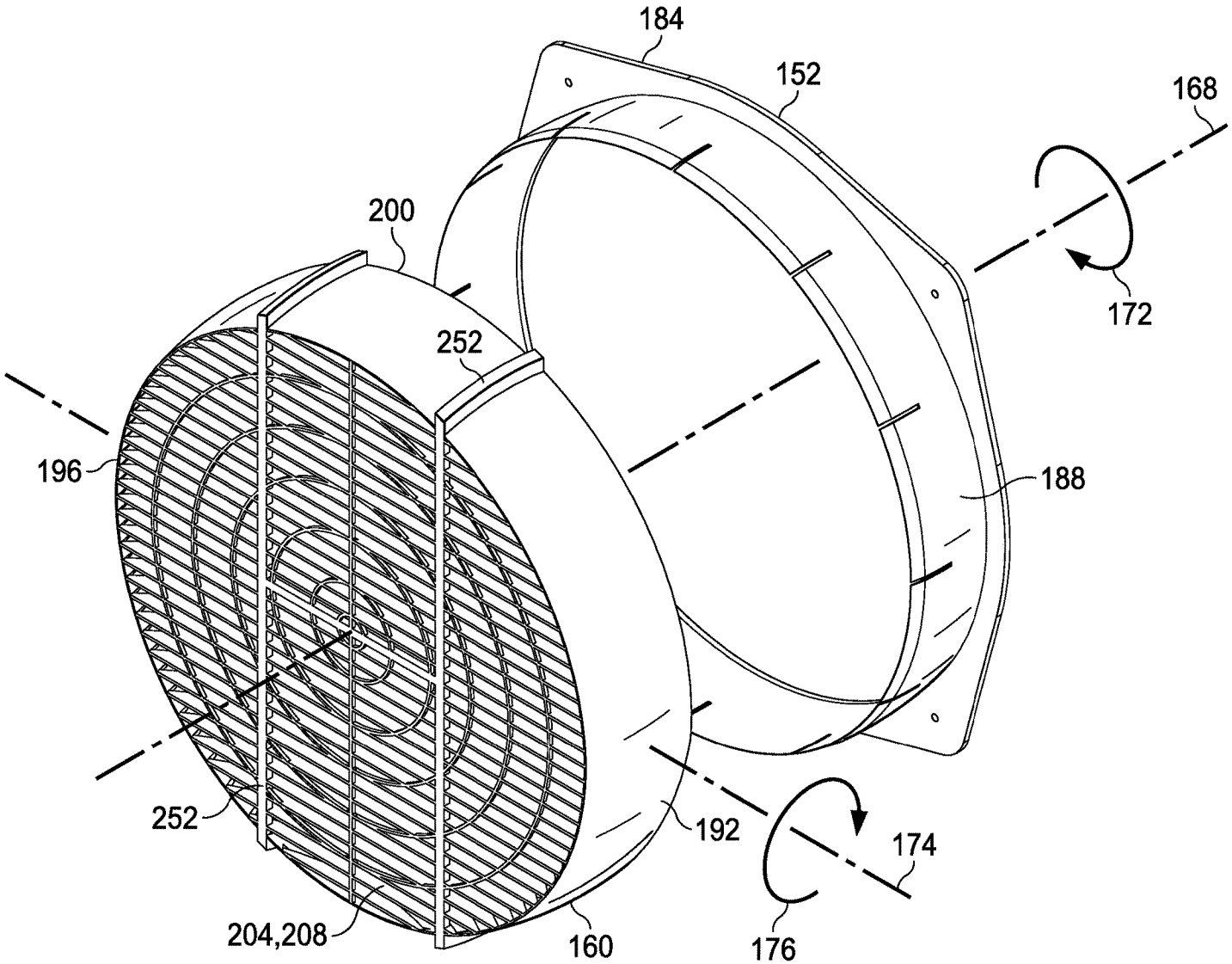
FIG. 3 is a schematic, exploded, perspective view of a fan guard and fan base assembly.

Referring now primarily to FIG. 3, a portion of a cooling unit is presented, namely, an illustrative embodiment of a fan base and a fan guard assembly having a fan guard 160 and its corresponding fan base 152. The fan base and fan guard assembly is shown in an exploded presentation.

The fan base 152 includes a flange portion 184 and a conduit portion 188. The flange portion 184 forms an angle with the conduit portion 188 that is substantially orthogonal, e.g., forms an angle between 70 and 110 degrees. The flange portion 184 is coupled to the front panel 140 (FIG. 2) in a substantially flush manner and about the fan aperture 144 (FIG. 2). The fan aperture 144 and fan base 152 are concentric about the longitudinal axis 168.

The fan guard 160 is moveably coupled to the fan base 152, with the fan guard 160 over the fan base 152. The fan guard goes over and mates with an interference fit on the conduit portion 188 of the fan base 152. The interference fit may be loose enough to allow relative movement to be accomplished by hand and yet tight enough and strong enough that the fan guard 160 and fan base 152 will not move relative to each other under the mere influence of vibration during operation of the cooling unit.

The fan guard 160 includes a fan-guard conduit member 192, which has a first longitudinal end 196 and a second longitudinal end 200. The first longitudinal end 196 is further from the front panel 140 (FIG. 2) than the second longitudinal end 200 when in an assembled position as shown in FIG. 2. The fan-guard conduit member 192 extends between the first longitudinal end 106 and the second longitudinal end 200 and is concentric about the first longitudinal axis 168 when in the assembled position as shown in FIG. 2.

The fan guard 160 includes a grill front wall 204. The grill front wall 204 is coupled to the fan-guard conduit member 192 at the first longitudinal end 196. The grill front wall 204 includes a plurality of protection bars 208 that cover an opening formed at the first longitudinal end 196 of the fan-guard conduit member 192 to avoid unrestricted access to a fan blade. The fan blades are positioned in an interior of the cabinet 132 (FIG. 2) proximate the fan aperture 144. The grill front wall 204 restricts access, keeps a human hand or other items from getting into the fan blades, but also allows air flow through the grill front wall 204. The grill front wall 204 is permeable for purposes of the air flow going through it.

There is an opening formed on the fan-guard conduit member 192 at the second longitudinal end 200, which is longitudinally opposite the opening covered by the grill front wall 204. As previously referenced, the opening in the fan guard 160 on the second longitudinal end 200 is sized and configured to form an interference fit with at least a portion of the conduit portion 188 of the fan base 152 while allowing rotation of the fan guard 160 relative to the fan base 152 about the longitudinal axis 168; that is, the fan guard can still be twisted or rotated. At the same time, the interference fit may be strong enough that relative movement due to mere vibration during operation between the fan guard 160 and the fan base 152 is eliminated or greatly reduced from a loose fit.

The second longitudinal end 200 of the fan-guard conduit member 152 is at least partially angled with respect to parts of its perimeter to allow rotation about a lateral axis 174 in order to pitch (see 176) the direction of the grill front wall 204. Thus, pushing the angled portion against the flange portion 184 will cause the air exiting the grill front wall 204 to be directed at an angle from where the longitudinal axis 168 would be in the neutral position. The neutral position refers to zero pitch, i.e., the direction before applying a pitch 176 movement. The fan guard 160 may then be rotated 172 about the longitudinal axis 168 to allow the directed air to go in any of 360 degrees.

Portion 184 may form an apron around the conduit portion 188. The flange portion 184 may include a plurality of fastener apertures for receiving a fastener securing the flange portion 184 to the front panel 140. The flange portion 184 may be circular, rectangular, or irregularly shaped.

Figure 6:
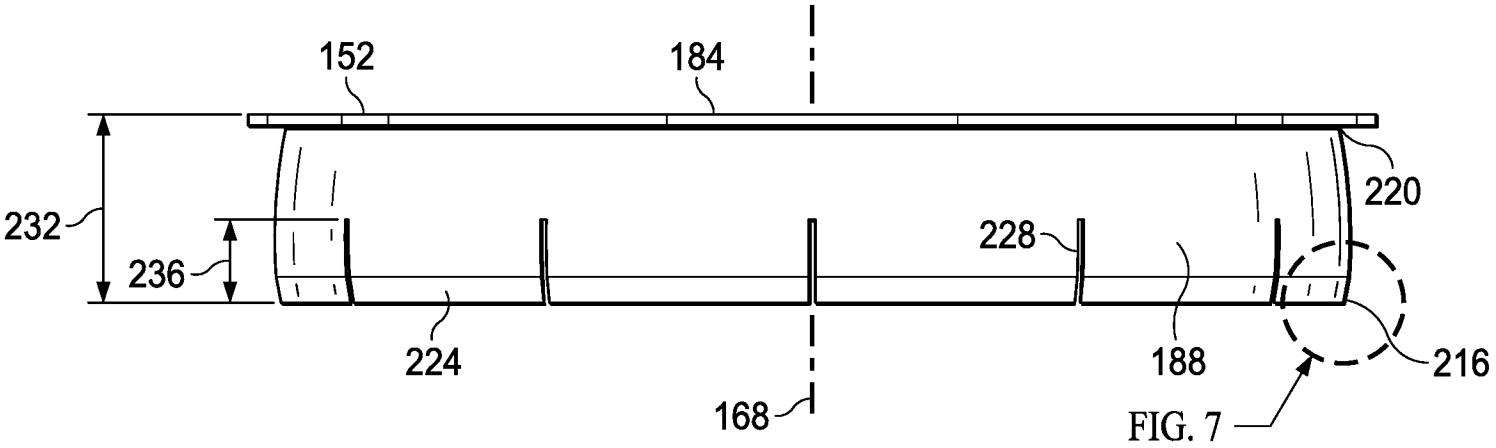
FIG. 6 is a schematic top plan view of the fan base of FIG. 5.

As shown best in the top view of FIG. 6, the conduit portion 188 is coupled to the flange portion 184 at substantially a 90° angle, but may include a curve and may comprise a slightly adjusted angle, e.g., 80-110 degrees. The conduit portion 188 has a first end 216, or distal end, and a second end 220, or proximal end. Again, the second end 220 is coupled to the flange portion 184 and has an aperture that substantially matches that of the fan aperture 144 (FIG. 2). The first end 216 may be formed with a reduced-thickness lip 224, where the thickness of the wall that forms the conduit portion 188 has been thinned by between 5 and 60 percent. The reduced-thickness lip 224 is to facilitate the mating interference fit with the fan guard 160. In addition, to facilitate the mating and the interference fit, a plurality of slots 228 may be formed on the first end 216 of the conduit portion 188. If the longitudinal length 232 of the conduit portion 188 is L, the longitudinal length 236 of the slots 228 is less than or equal to ½ L. In one illustrative embodiment, the longitudinal length 236 of the slots was between 1 and 3 inches.

Figure 4:
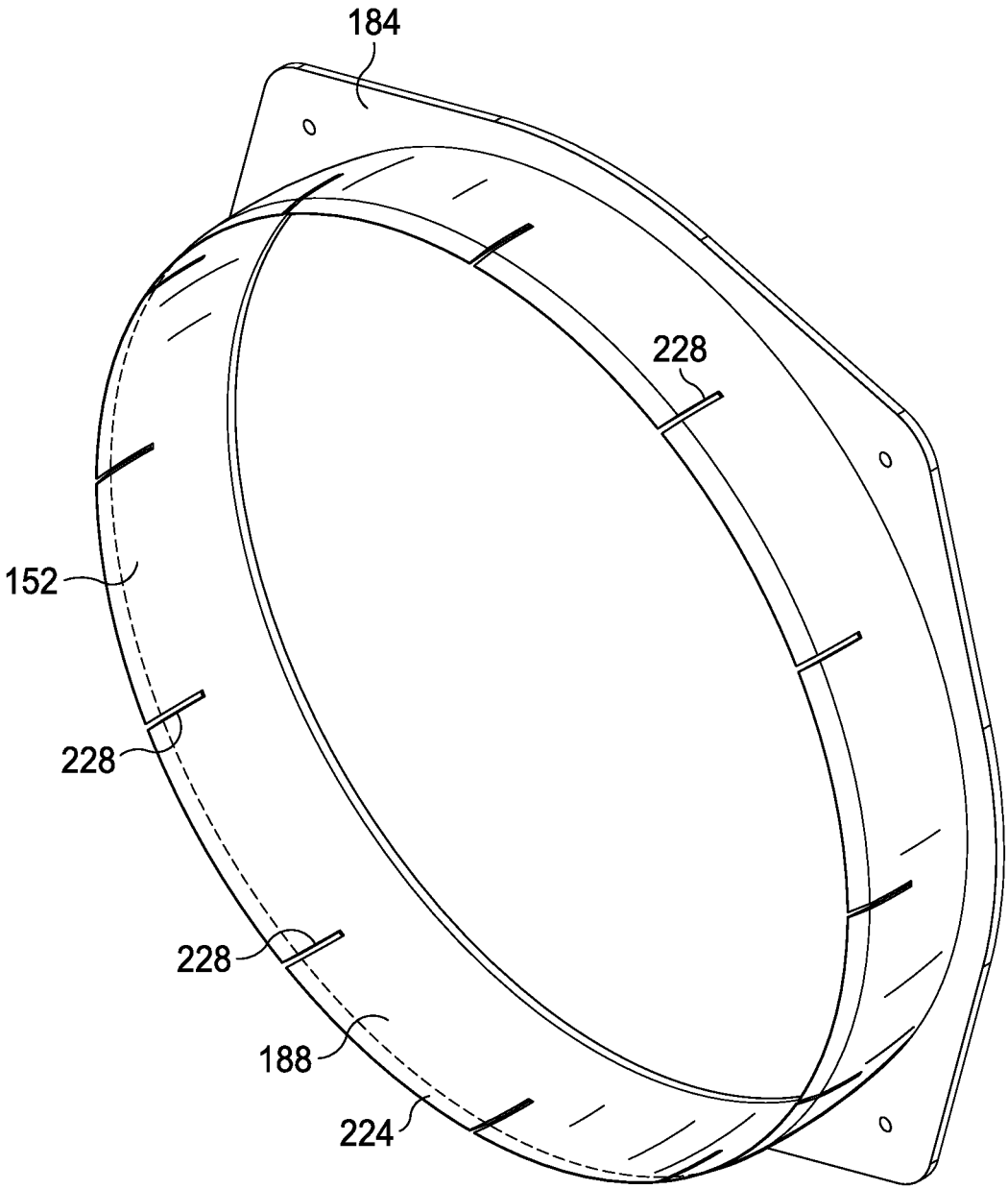
FIG. 4 is a schematic, perspective view of a fan base.
Figure 5:
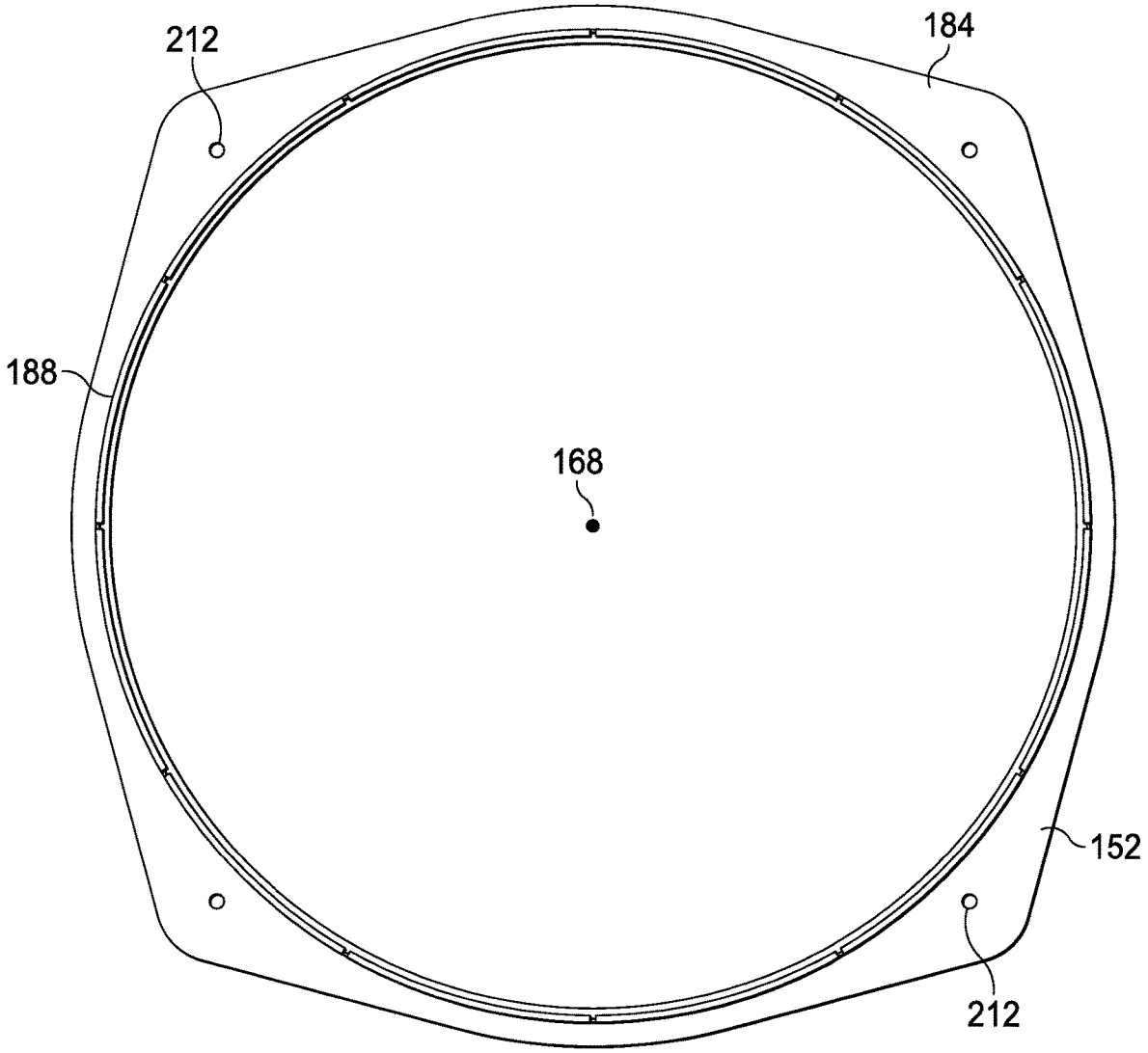
FIG. 5 is a schematic plan view in elevation of the fan base of FIG. 4.
Figure 7:
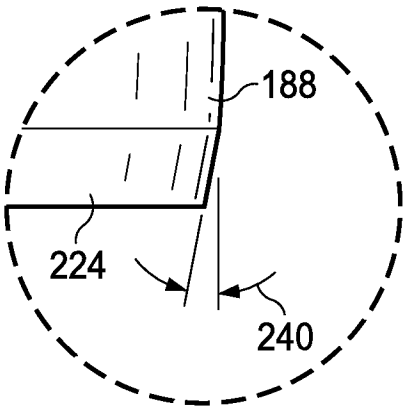
FIG. 7 is a schematic detail of a portion of the fan base of FIG. 6.
Figure 8:
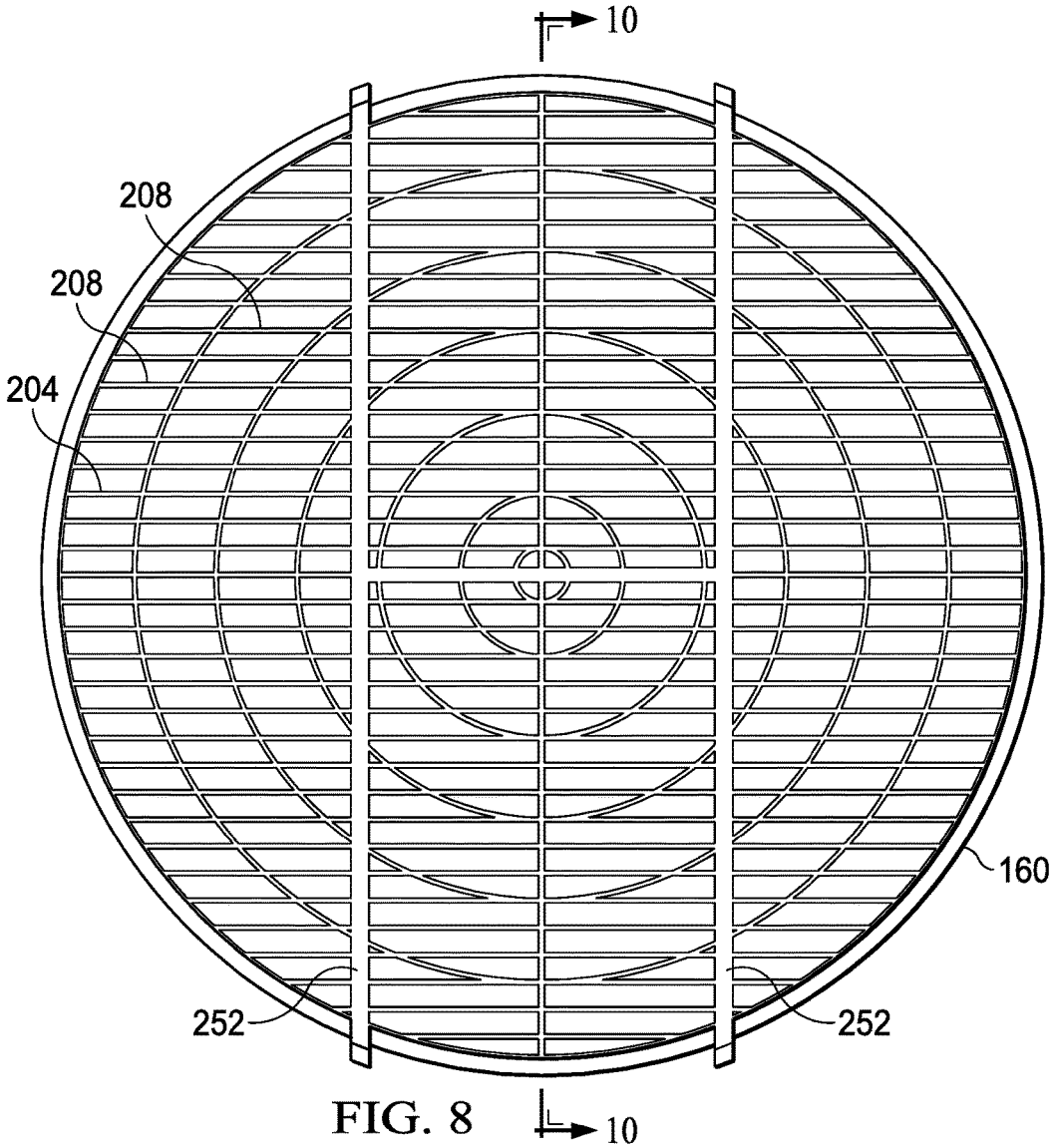
FIG. 8 is a schematic, elevation view of a fan guard.
Figure 9:
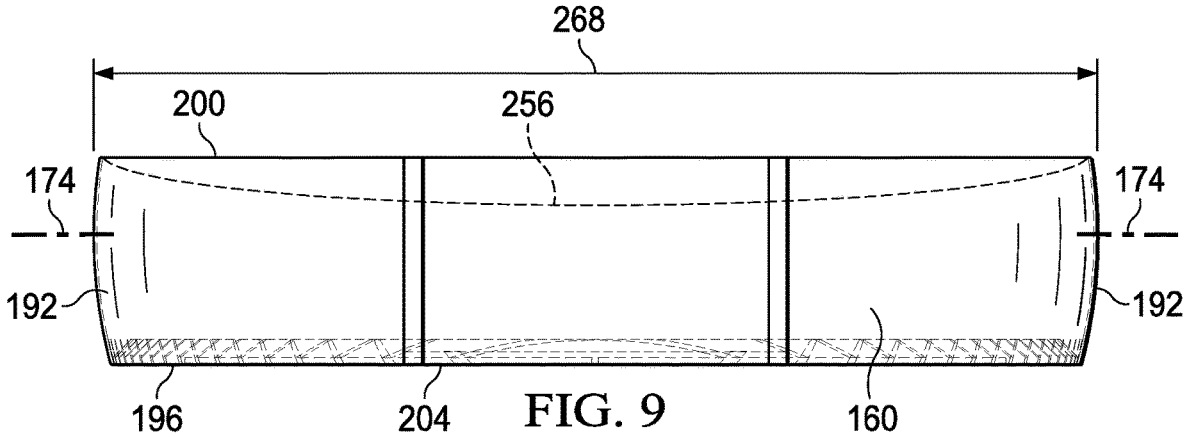
FIG. 9 is a schematic top plan view of the fan guard of FIG. 8.

The slots 228 have a width of between 0.08-0.25 inches. In one embodiment, the slots are sized and configured such that the slots allow enough give in the guard base to allow the fan guard to install over the base. The slots 228 may be evenly distributed about the circumference of the conduit portion 188 or may be patterned. In the illustrative embodiment shown in FIG. 4, 12 slots were used. With the length 236 less than half of the length 232, the slots 228 will not show when the fan guard 160 and fan base 152 are assembled the moved relative to one another; this makes for a secure attachment, avoids leaks, and looks better. To also help with the mating of the conduit portion 188 of the fan base 152 with the fan guard 160, the first end 216 may be angled inward, i.e., a slight draft 240 formed, as shown in FIG. 7. In one illustrative embodiment, the draft 240 is in the range of 0.5 to 3 degrees.

Figure 10:
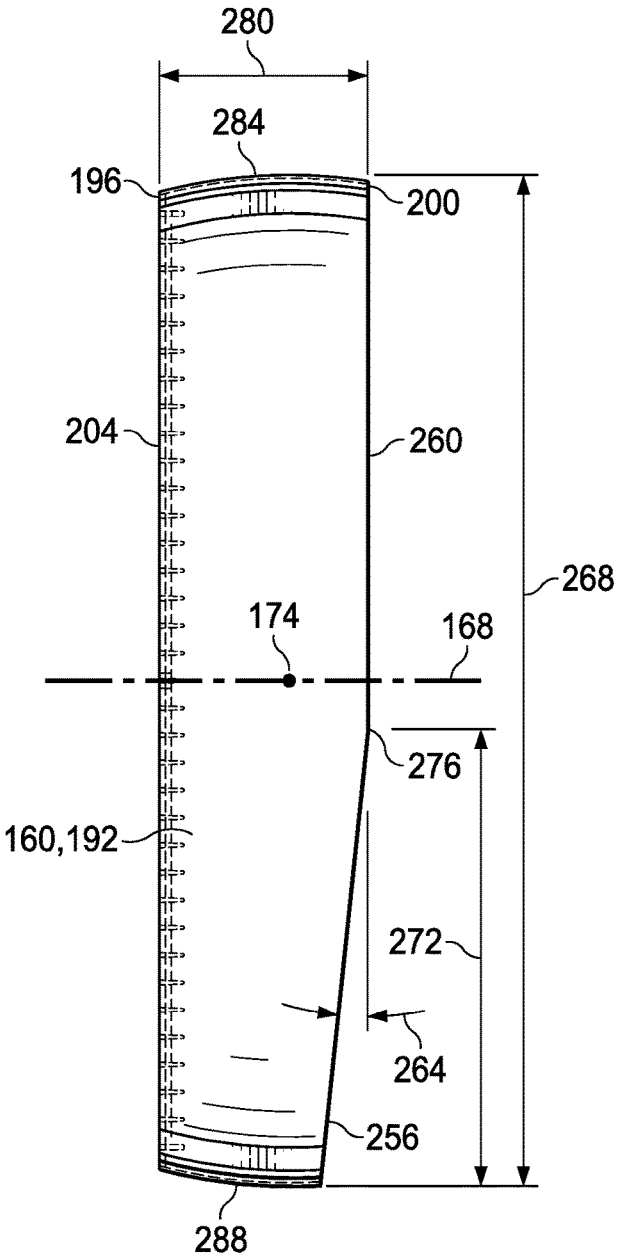
FIG. 10 is a schematic elevation cross-sectional view of the fan guard of FIG. 8 from a right side.
Figure 11:
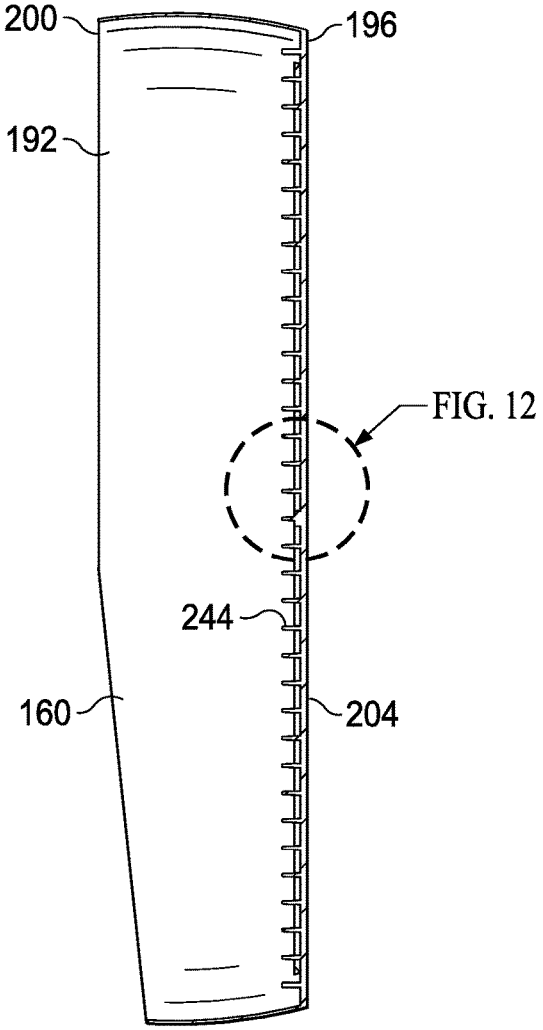
FIG. 11 is a schematic elevation view of the fan guard from a left side.
Figure 12:
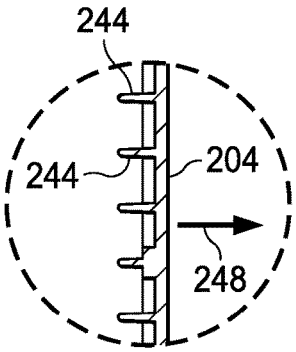
FIG. 12 is a detail of a portion of the fan guard of FIG. 11.

Referring now primarily to FIGS. 8-12, the illustrative embodiment of the fan guard 160 is presented. As shown in the top view of FIG. 9, the fan guard 160 has the fan-guard conduit member 192 with the first longitudinal end 196 and the second longitudinal end 200. The fan-guard conduit member 192 is a tube-shaped member to direct the airflow through it. The first longitudinal end 196 is covered by grill front wall 204. As shown in FIGS. 11 and 12, the grill front wall 204 may include a plurality of protective bars 208 having a plurality of veins 244. The protective bars 208 may take many shapes, e.g., straight bars and circular bars as shown or any other pattern. The space of the protective bars 208 is small enough to prevent a human hand from going through it, but spaced enough to allow airflow to readily go through. The veins 244 help direct the airflow 248. A plurality of ribs 252 may be coupled at least partially to the grill front wall 204 and may also be coupled to an exterior portion of the fan-guard conduit member 192 as shown best in FIG. 3.

As probably shown best in the side view of FIG. 10, the fan guard 160 on the second longitudinal end 200 has an angled portion 256 and a non-angled portion 260; the angled portion 256 may have an angle 264 between 2 and 10 degrees with respect to the non-angled portion. If the lateral width 268 of the fan-guard conduit member 192 is X, then the lateral width 272 angled portion 256 has length less than or equal to ½ X. A longer lateral width 268 of the fan-guard conduit member 192 of the fan guard 160 and the associated base 152 will allow a larger air throw angle (angle of portion 256); if made taller or longer, the angle can be increased.

Another way to consider the angled portion 264 is to consider the longitudinal length of the fan guard conduit member 192. With reference still to FIG. 10, a longest portion 280 longitudinally of the fan-guard conduit member 192 has a longitudinal length Y; wherein the second longitudinal end of the conduit member is at least partially angled forming the angled portion 256, such that a portion of the fan-guard conduit member 192 is longer on a first longitudinal side 284 than on an second longitudinal side 288, which is a shorter side; and wherein the shorter side 288 has a length greater than ½ Y.

Figure 13:
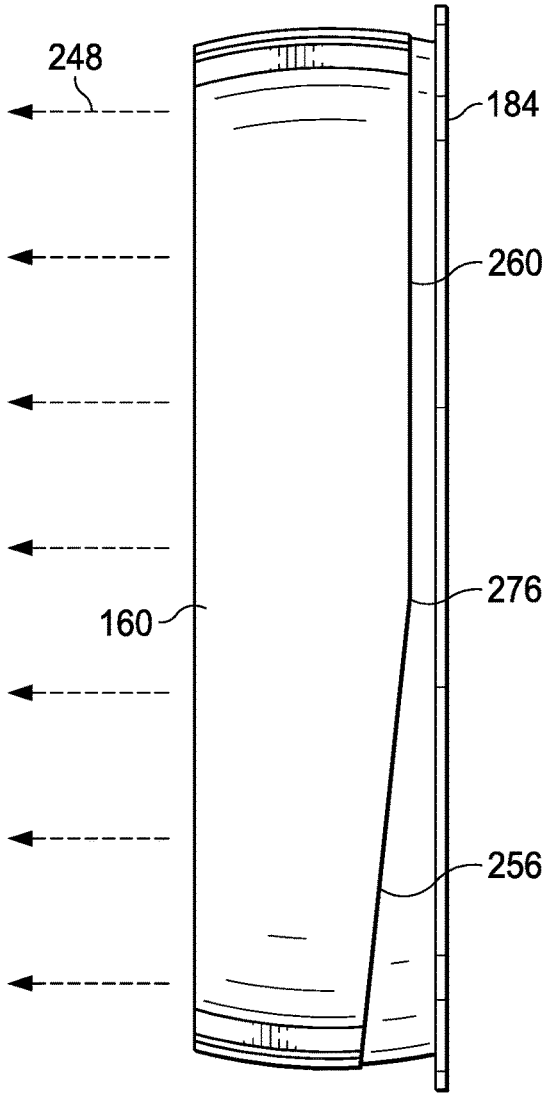
FIG. 13 is a schematic side elevation view of a fan base and fan guard assembly.
Figure 14:
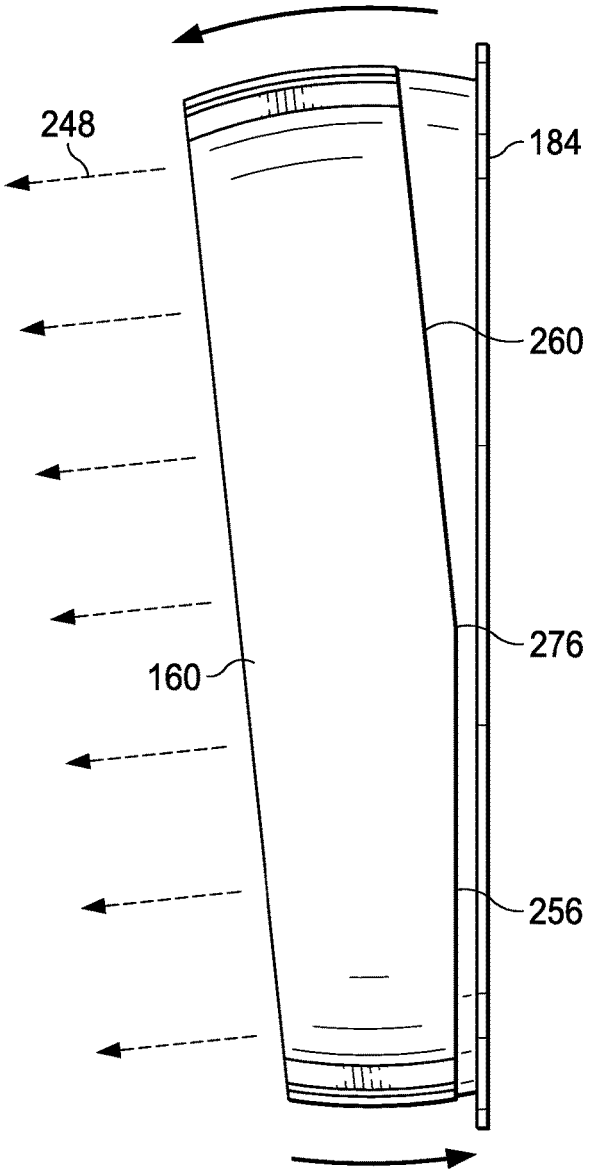
FIG. 14 is the same as FIG. 13 with the fan guard rotated relative to the fan base.

With reference primarily to FIGS. 10, 13, and 14, it will be appreciated that when it is desired to rotate the fan guard 160 about the lateral axis 196 to adjust the pitch 176 going from a neutral position (FIG. 13), one may push the fan guard 160 to cause rotation about a de factor fulcrum 276 causing the angled portion 256 to come closer to the flange portion 184 and the non-angled portion 260 to move further away from the flange portion 184. This can be done through the whole range of the angle that makes the angled portion. In this way, the air flow 248 goes from being directed straight out (FIG. 13) to being directed downward (FIG. 14; for the orientation shown). Combining this with the ability to rotate 172 the fan guard 160 about the longitudinal axis 168, and one will appreciate the airflow 248 may be directed at the prescribed angle in any direction, e.g., upward, left, right, or anything within 360 degrees.

Figure 15:
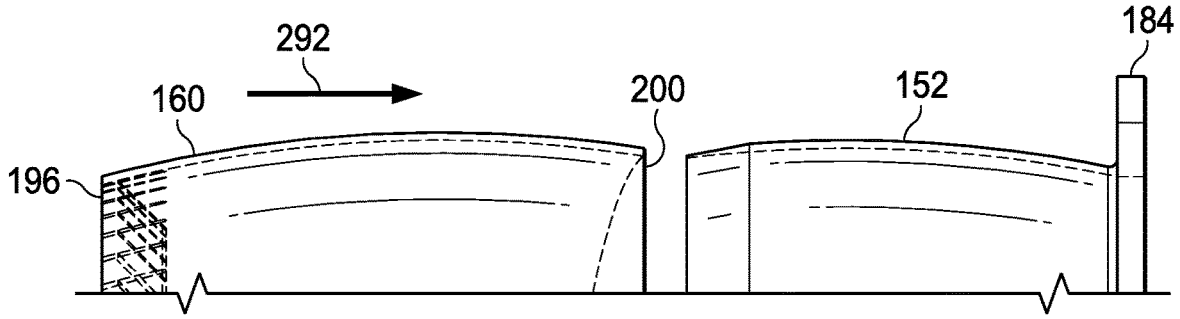
FIG. 15 is a partial, elevation view of the fan base and fan guard during an assembly process.

With respect to manufacturing the cooling unit 104 and in particular the fan base 152 and fan guard 160, the components may be made from metal, e.g., stainless steel, or from plastic. The fan base 152 and fan guard 160 may be injection molded. In one illustrative embodiment, the materials used are non-corrosive. With references now primarily to FIG. 15, to assemble the fan base 152 and fan guard 160, The second longitudinal end 200 of the fan guard 160 is moved in the direction 292 such that the opening at the second longitudinal end 200 receives the first end 216 of the fan base 152. The movement in the direction of 292 continues until a portion of the second end 200 of the fan guard is substantially adjacent to the flange portion 184 of the fan base 152.

According to an illustrative embodiment, a cooling unit for cooling a refrigerated room, includes a cabinet formed with a plurality of panels including a front panel; a fan aperture formed in the front panel; a fan base having a flange portion and a conduit portion, wherein the flange portion forms an angle with the conduit portion of between 70 and 110 degrees, and wherein the flange portion is coupled to the front panel in a substantially flush manner and about the fan aperture, the fan aperture and fan base concentric about a longitudinal axis; and a fan guard for moveably coupling to the fan base, with the fan guard over the fan base. The fan guard includes: a fan-guard conduit member having a first longitudinal end and a second longitudinal end, wherein the first longitudinal end is further from the front panel than the second longitudinal end when in an assembled position. The fan-guard conduit member extends between the first longitudinal end and the second longitudinal end and concentric about the first longitudinal axis when in the assembled position. The guard further includes a grill front wall coupled to the fan-guard conduit member at the first longitudinal end. The grill front wall comprises a plurality of protection bars that cover an opening formed at the first longitudinal end of the fan-guard conduit member to avoid unrestricted access to a fan blade while allowing air flow through the grill front wall. The guard further includes an opening formed on the fan-guard conduit member at the second longitudinal end. The opening is sized and configured to form an interference fit with at least a portion of the conduit portion of the fan base while allowing rotation of the fan guard relative to the fan base about the longitudinal axis, and wherein the second longitudinal end of the fan-guard conduit member is at least partially angled to allow rotation about a lateral axis in order to pitch the direction of the grill front wall, and wherein the angled portion is between 3 and 8 degrees relative to the flange portion of the fan base when in an assembled position. The at least partially angled portion forms an angle between 3 and 8 degrees relative to the flange portion of the fan base when in an assembled position and when a non-angled portion of the second longitudinal end of the conduit member is substantially flush with the flange portion of the fan base, and wherein a lateral width of the fan-guard conduit member is X and wherein the at least partially angled portion has length less than ½ X. The guard may further includes a reduced-thickness lip that is formed on the distal end of the conduit portion of the fan base; A longest portion of the conduit portion of the base has a length Y and wherein the plurality of slots has a length less than or equal to ½ Y. The fan guard further includes a plurality of ribs coupled at least partially to the grill front wall. The second longitudinal end of the fan-guard conduit member is at least partially angled to allow rotation about the lateral axis in order to pitch the direction of the grill front wall, and wherein the angled portion is between 3 and 8 degrees relative to the flange portion of the fan base when in an assembled position.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A cooling unit for cooling a refrigerated room, the cooling unit comprising:

a cabinet formed with a plurality of panels including a front panel;

a fan aperture formed in the front panel;

a fan base having a flange portion and a conduit portion, wherein the flange portion forms an angle with the conduit portion of between 70 and 110 degrees, and wherein the flange portion is coupled to the front panel in a substantially flush manner and about the fan aperture, the fan aperture and fan base concentric about a longitudinal axis; and a fan guard for moveably coupling to the fan base, with the fan guard over the fan base, the fan guard comprising:

a fan-guard conduit member having a first longitudinal end and a second longitudinal end, wherein the first longitudinal end is further from the front panel than the second longitudinal end when in an assembled position, the fan-guard conduit member extending between the first longitudinal end and the second longitudinal end and concentric about the first longitudinal axis when in the assembled position, a grill front wall coupled to the fan-guard conduit member at the first longitudinal end, the grill front wall comprising a plurality of protection bars that cover an opening formed at the first longitudinal end of the fan-guard conduit member to avoid unrestricted access to a fan blade while allowing air flow through the grill front wall, an opening formed on the fan-guard conduit member at the second longitudinal end, wherein the opening is sized and configured to form an interference fit with at least a portion of the conduit portion of the fan base while allowing rotation of the fan guard relative to the fan base about the longitudinal axis, and wherein the second longitudinal end of the fan-guard conduit member is at least partially angled to allow rotation about a lateral axis in order to pitch the direction of the grill front wall.

2. The cooling unit of claim 1, wherein the conduit portion of the fan base has a distal end that is outward facing when in the assembled position and a proximal portion that is coupled to the flange portion, and wherein the distal end of the fan base is formed with a plurality of slots, wherein the plurality of slots is greater than four in number and wherein each slot of the plurality of slots has a width of at least 0.1 inches.

3. The cooling unit of claim 2, wherein a reduced-thickness lip is formed on the distal end of the conduit portion of the fan base.

4. The cooling unit of claim 2, wherein a longest portion of the conduit portion of the fan base has a longitudinal length Y and wherein the plurality of slots has a longitudinal length less than or equal to ½ Y.

5. The cooling unit of claim 1, wherein a longest portion of the conduit member of the fan guard has a longitudinal length Y; wherein the second longitudinal end of the conduit member is at least partially angled such that a portion of the fan-guard conduit member is longer on a first longitudinal side than on an opposing second longitudinal side, which is a shorter side; and wherein the shorter side has a length greater than ½ Y.

6. The cooling unit of claim 1, further comprising a plurality of ribs coupled at least partially to the grill front.

7. The cooling unit of claim 1, further comprising a plurality of ribs coupled at least partially to the grill front and having a portion coupled to the conduit member on an exterior side.

8. The cooling unit of claim 1, wherein the interference fit between the fan-guard conduit member at second longitudinal end and the conduit portion of the fan base is loose enough that the fan-guard conduit member may be rotated relative to the conduit portion of the fan base by hand and tight enough to not have relative movement from vibration during operation of the cooling unit.

9. The cooling unit of claim 1, wherein the second longitudinal end of the fan-guard conduit member is at least partially angled to form an angled portion that allows rotation about the lateral axis in order to pitch the direction of the grill front wall, and wherein the angled portion is between 3 and 8 degrees relative to the flange portion of the fan base when in an assembled position.

10. The cooling unit of claim 9, wherein a non-angled portion of the second longitudinal end of the fan-guard conduit member is substantially flush with the flange portion of the fan base when in a neutral position, and wherein a lateral width of the fan-guard conduit member is X and wherein the angled portion has length less than or equal to ½ X.

11. The cooling unit of claim 9, wherein the angled portion forms an angle between 3 and 8 degrees relative to the flange portion of the fan base when in an assembled position and wherein a non-angled portion of the second longitudinal end of the fan-guard conduit member is substantially flush with the flange portion of the fan base in a neutral position, wherein a lateral width of the fan-guard conduit member is X and wherein the angled portion has length less than or equal to ½ X;

wherein a longest portion longitudinally of the fan-guard conduit member has a longitudinal length Y;

wherein the second longitudinal end of the conduit member is at least partially angled such that a portion of the fan-guard conduit member is longer on a first longitudinal side than on an opposed second longitudinal side, which is a shorter side; and wherein the shorter side has a length greater than ½ Y.

12. The cooling unit of claim 1, wherein the second longitudinal end of the fan-guard conduit member is at least partially angled to allow rotation about the lateral axis in order to pitch the direction of the grill front wall, and wherein the angled portion is angled greater than 5 degrees.

13. The cooling unit of claim 1, wherein the second longitudinal end of the fan-guard conduit member is at least partially angled to allow rotation about the lateral axis in order to pitch the direction of the grill front wall;

wherein the at least partially angled portion forms an angle between 3 and 8 degrees relative to the flange portion of the fan base when in an assembled position and when a non-angled portion of the second longitudinal end of the conduit member is substantially flush with the flange portion of the fan base;

wherein a lateral width of the fan-guard conduit member is X and wherein the at least partially angled portion has length less than ½ X;

wherein a reduced-thickness lip is formed on the distal end of the conduit portion of the fan base;

wherein a longest portion of the conduit portion of the base has a length Y and wherein the plurality of slots has a length less than or equal to ½ Y; and further comprising a plurality of ribs coupled at least partially to the grill front wall.

14. A cooling unit for cooling a refrigerated room, the cooling unit comprising:

a cabinet formed with a plurality of panels including a front panel;

a fan aperture formed in the front panel;

a fan base having a flange portion and a conduit portion, the flange portion coupled to the front panel in a substantially flush manner and about the fan aperture, the fan aperture and fan base concentric about a longitudinal axis, the flange portion and the conduit portion coupled to form an angle of between 80 and 110 degrees between;

a fan guard for moveably coupled to the fan base, the fan guard comprising:

a fan-guard conduit member having a first longitudinal end and a second longitudinal end with a longitudinal distance of L therebetween, wherein the first longitudinal end is further from the front panel than the second longitudinal end when in an assembled position, the fan-guard conduit member extending between the first longitudinal end and the second longitudinal end and being concentric about the longitudinal axis when in the assembled position in a neutral position, a grill front wall coupled to the conduit member at the first longitudinal end, the grill front wall comprising a plurality of protection bars that cover an opening formed at the first longitudinal end of the fan-guard conduit member to avoid unrestricted access to a fan blade while allowing air flow through the grill front wall, an opening formed on the fan-guard conduit member at second longitudinal end that is sized and configured to form an interference fit with the conduit portion of the fan base while allowing rotation about the longitudinal axis when in the assembled position and the neutral position, and wherein the second longitudinal end of the fan-guard conduit member is at least partially angled to allow rotation about a lateral axis in order to pitch the direction of the grill front wall, wherein the neutral position is associated with zero pitch;

wherein the conduit portion of the fan base has a distal end that is outward facing when in the assembled position and a proximal portion that is coupled to the flange portion, and wherein the distal end of the fan base is formed with a plurality of slots, wherein the plurality of slots is greater than four and wherein each slot of the plurality of slots has a width of at least 0.1 inches;

wherein a reduced-thickness lip is formed on the distal end of the conduit portion of the fan base;

wherein a longest portion of the conduit portion of the fan base has a length Y and wherein the plurality of slots has a length less than or equal to ½ Y;

further comprising a plurality of ribs coupled at least partially to the grill front and having a portion coupled to the conduit member on an exterior side;

wherein the interference fit between the fan-guard conduit member at the second longitudinal end and the conduit portion of the fan base is loose enough that the fan-guard conduit member may be rotated relative to the conduit portion of the fan base by hand and yet tight enough to not move from mere vibration during operation;

wherein the second longitudinal end of the fan-guard conduit member is at least partially angled to form an angled portion and to allow rotation about the lateral axis in order to pitch the direction of the grill front wall, and wherein the angled portion is between 3 and 8 degrees relative to the flange portion of the fan base when in an assembled position and in the neutral position;

wherein a portion of the second longitudinal end of the fan-guard conduit member forms a non-angled portion that is substantially flush with the flange portion of the fan base when in the assembled position and in the neutral position;

wherein a lateral width of the fan-guard conduit member is X and wherein the angled portion has length less than ½ X;

wherein the second longitudinal end of the fan-guard conduit member is at least partially angled such that a portion of the conduit member is longer on a first longitudinal side than on an opposing second longitudinal side, which is a shorter side; and wherein the shorter side has a length greater than ½ L; and wherein the fan base and the fan guard are formed from a plastic material.

15. A fan guard and fan base assembly for use as an aspect of a cooling unit for cooling a refrigerated room, the cooling unit having a cabinet formed with a plurality of panels including a front panel and a fan aperture formed in the front panel for allowing cooled air from a fan to be discharged, the fan guard and fan base assembly comprising:

a fan base having a flange portion that mounts substantially flush with the front panel when in an assembled position and having a conduit portion coupled to the flange portion, wherein the conduit portion extends outward from the flange portion when in the assembled position, and wherein the conduit portion of the fan base has a first longitudinal end and a second longitudinal end, wherein the second longitudinal end is coupled to the flange portion;

a fan guard having a conduit member that extends longitudinally from a first longitudinal end to a second longitudinal end, wherein the second longitudinal end is closest, as compared to the first longitudinal end, to front panel when in the assembled position, wherein first longitudinal end of the conduit member of the fan guard is covered by a grill that allows air to pass therethrough but restricts access by a human hand, wherein an opening at the second longitudinal end of the conduit member of the fan guard is sized and configured to mate with the first longitudinal end of the conduit portion of the fan base and to form an interference fit therebetween; and wherein the second longitudinal end of the fan guard is partially angled in shape to form an angled portion and a non-angled portion that allows for rotation about a lateral axis through the fan guard.

16. The fan guard and fan base assembly of claim 15, wherein in an assembled position with the non-angled portion of the fan guard flush against the flange portion of the fan base, an angle is formed between the angled portion and the flange portion that is between 2 and 10 degrees.

17. The fan guard and fan base assembly of claim 15, further comprising a plurality of ribs coupled to the fan guard.

18. The fan guard and fan base assembly of claim 15, wherein the interference fit is strong enough to not move under an influence of mere vibration during operation and loose enough to allow relative movement by hand.

19. The fan guard and fan base assembly of claim 15, wherein a longitudinal length of the conduit member of the fan guard is L at a longest point, and wherein the conduit member of the fan guard is between ½ L and 0.8 L at a shortest point that is where the angled portion is.

20. The fan guard and fan base assembly of claim 15, wherein an outboard edge of the conduit portion of the fan base is formed with a plurality of slots.

21. The fan guard and fan base assembly of claim 15, wherein in an assembled position with the non-angled portion of the fan guard flush against the flange portion of the fan base, an angle is formed between the angled portion and the flange portion that is between 2 and 10 degrees;

further comprising a plurality of ribs coupled to the fan guard;

wherein the interference fit is strong enough to not move under an influence of mere vibration during operation and loose enough to allow relative movement by hand;

wherein a longitudinal length of the conduit member of the fan guard is L at a longest point, and wherein the conduit member of the fan guard is between ½ L and 0.8 L at a shortest point that is where the angled portion is; and wherein an outboard edge of the conduit portion of the fan base is formed with a plurality of slots.

* * * * *